US006223609B1

(12) United States Patent
Leifeld et al.

(10) Patent No.: US 6,223,609 B1
(45) Date of Patent: May 1, 2001

(54) APPARATUS FOR MEASURING THE THICKNESS AND/OR IRREGULARITIES OF A RUNNING SLIVER

(75) Inventors: Ferdinand Leifeld, Kempen; Pedro Corrales, Mönchengladbach, both of (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/442,146

(22) Filed: Nov. 18, 1999

(30) Foreign Application Priority Data

Nov. 18, 1998 (DE) ..... 198 53 238

(51) Int. Cl.[7] ..... G01L 1/04

(52) U.S. Cl. ..... 73/862.472; 73/862.392; 73/829; 19/105

(58) Field of Search ..... 73/818, 824, 829, 73/862.391, 862.472, 862.392, 862.621; 19/105

(56) References Cited

U.S. PATENT DOCUMENTS

| | | | | |
|---|---|---|---|---|
| 4,712,367 | * | 12/1987 | Lassmann | 57/263 |
| 4,955,266 | * | 9/1990 | Staheli et al. | 19/105 |
| 5,606,509 | * | 2/1997 | Denz et al. | 364/470.14 |
| 5,673,462 | | 10/1997 | Leifeld . | |

FOREIGN PATENT DOCUMENTS

| | | |
|---|---|---|
| 1 064 911 | 9/1959 | (DE) . |
| 19 46 316 | 9/1966 | (DE) . |
| 37 26 628 | 2/1989 | (DE) . |
| 44 11 203 | 10/1995 | (DE) . |
| 195 00 189 | 7/1996 | (DE) . |
| 0 649 923 | 4/1995 | (EP) . |
| 2 221 699 | 2/1990 | (GB) . |
| 2 329 477 | 3/1999 | (GB) . |
| 91/16595 | 10/1991 | (WO) . |

* cited by examiner

*Primary Examiner*—Max Noori
(74) *Attorney, Agent, or Firm*—Venable; Gabor J. Kelemen

(57) ABSTRACT

An apparatus for advancing a sliver and sensing thickness variations thereof in a fiber processing machine includes a tongue-and-groove roll pair composed of a tongue roll and a groove roll. The groove roll is radially fixedly supported and has a circumferentially extending groove including a groove bottom. The tongue roll projects into the groove and defines, with the groove roll, a nip through which the sliver passes for being compressed and advanced by the tongue-and-groove roll pair. The apparatus further has a sensing device including a biased, movably supported sensor element projecting into the groove of the groove roll and cooperating with the groove bottom upstream of the nip as viewed in a direction of sliver advance for pressing the sliver against the groove bottom and for undergoing excursions in response to thickness variations of the sliver passing between the sensor element and the groove bottom.

19 Claims, 6 Drawing Sheets

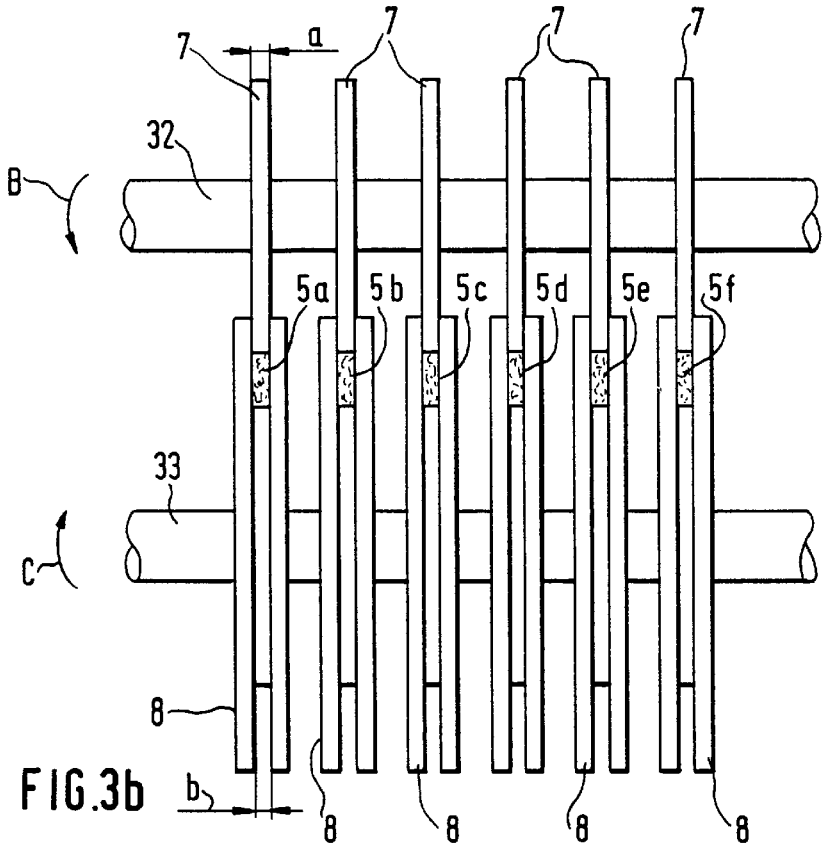
FIG.3b
FIG.4a
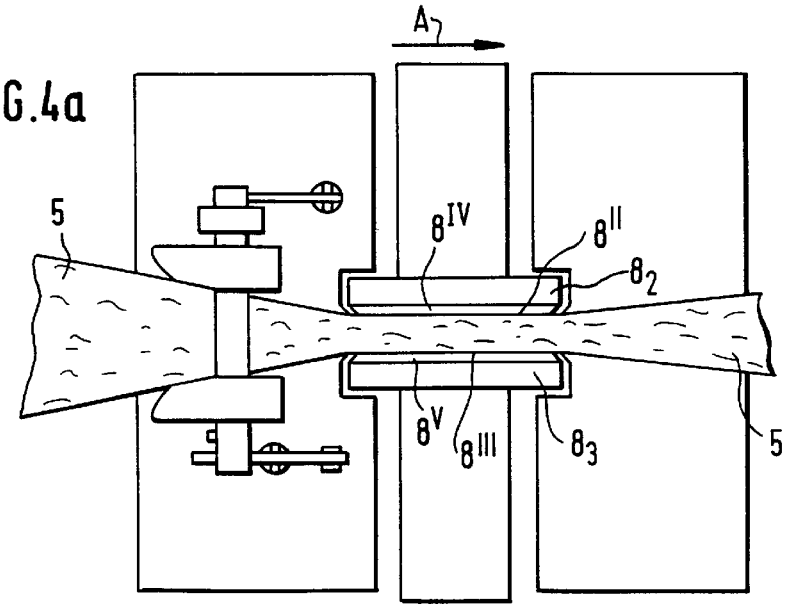

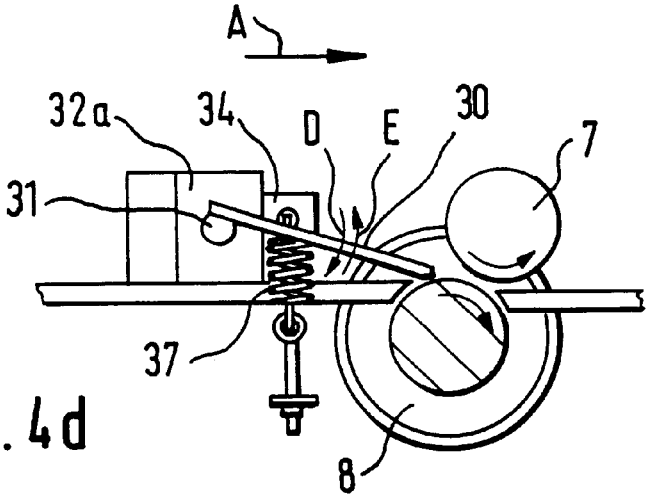
FIG. 4d
FIG. 4e
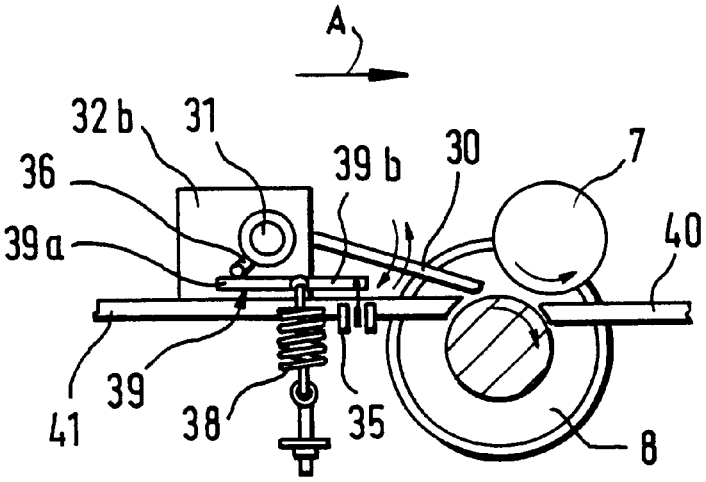

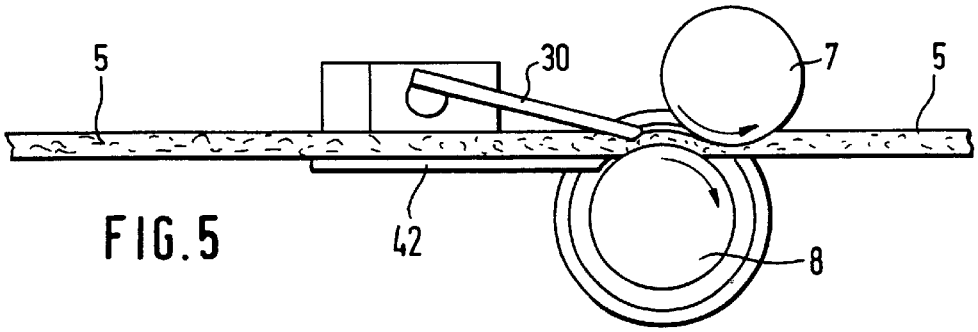
FIG.5
FIG.6
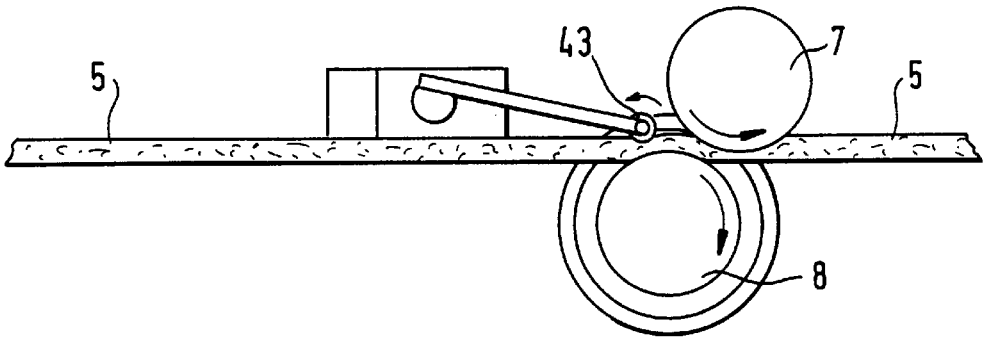
FIG.7
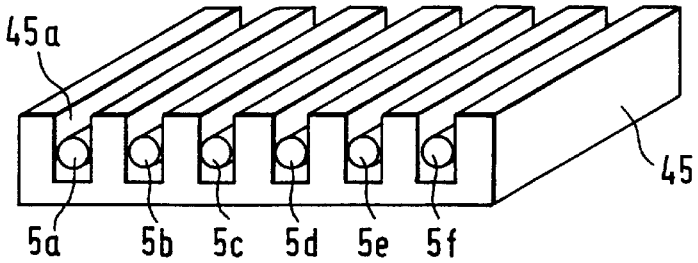

APPARATUS FOR MEASURING THE THICKNESS AND/OR IRREGULARITIES OF A RUNNING SLIVER

BACKGROUND OF THE INVENTION

The invention relates to an apparatus for measuring the thickness and/or irregularities of a running sliver in a spinning preparation machine, particularly a draw frame. The apparatus is of the type which has a biased sensor element which mechanically scans (contacts) the sliver and a tongue-and-groove roll pair which defines a closed nip of generally rectangular cross section through which the sliver passes. The groove roll of the roll pair has a radially fixed rotary axis.

Published PCT Application WO-A-91 16595 discloses an apparatus for guiding the slivers at the inlet end of the drawing unit of a draw frame. The apparatus includes a conically converging sheet metal support body having laterally upwardly bent wall faces and, downstream thereof (as viewed in the direction of sliver advance), a sliver guide having a rectangular inlet cross section, parallel-extending top and bottom walls and converging, upstanding lateral walls. The side-by-side arranged slivers glide on the supporting surface formed of the supporting body and the bottom wall of the sliver guide. Between the slivers and the side walls an intermediate space is provided at the sliver intake zone. The sliver guide is situated immediately in front of a pull-off roll pair whose parallel axes are vertically oriented. The roll pair also serves for measuring the sliver thickness within a predetermined tolerance range and, for such a purpose, the distance between the two cooperating rolls of the roll pair is variable. The radially movable, spring-loaded roll forms a biased, movable sensor element and is horizontally displaceable relative to the stationary roll. The stationary roll is a "groove roll" and is composed of a middle disk and two flanking disks. The middle disk has a smaller diameter than the two flanking disks whereby the circumferential peripheral face of the roll forms a circumferential groove. The radially movable roll is a "tongue roll" and is formed of a single disk which projects, with a peripheral portion, into the groove of the groove roll. The circumferential surface of the middle disk of the groove roll forms a rotary, radially stationary counterface for the circumferential surface of the radially movable tongue roll. By means of the tongue-and-groove construction an essentially rectangular constriction (nip) is formed between which a sliver bundle formed of a plurality of slivers passes in a compressed state for measuring purposes. In operation, the individual slivers run into the sliver guide at the drawing unit inlet with a speed of, for example, 150 m/min. The converging walls of the sliver guide gather the slivers without any clamping into a single plane so that they assume a side-by-side relationship. The slivers exiting the sliver guide are first densified by being pulled into the nip of the two downstream arranged rolls, that is, they are compressed to their solid material cross section and thus, in particular, enclosed air is expelled therefrom so that a measurement may take place. The circumferential speed of the rolls and the running speed of the slivers are identical so that no slippage takes place between the rolls, on the one hand, and the slivers, on the other hand. The clamping effect of the rolls required for exerting a pulling force is simultaneously used for the densification needed for the measuring step. After the slivers exit the roll nip they diverge laterally and enter the downstream-arranged drawing unit.

It is a disadvantage of the above-outlined apparatus that it involves substantial structural and operational outlay. It is a particular drawback that the drive of the two rolls is structurally complex and also, that a rotary drive has to be used for the radially displaceable roll. It is a further disadvantage that both rolls have to be driven. The drive for the radially movable roll includes a spur gear pair; one of the gears is mounted on the shaft of the roll while the other gear is arranged coaxially with the pivot axis of the pivotal arm carrying the radially displaceable roll. This arrangement ensures that the meshing relationship of the gears of the gear pair remains unchanged independently of a pivotal motion of the pivot arm. To obtain the required, opposite rotation of the rolls, a further, intermediate gear has to be provided which has the additional disadvantage that, apart from its complex structure, clearances between the individual gear teeth lead to accumulated inaccuracies.

SUMMARY OF THE INVENTION

It is an object of the invention to provide an improved apparatus of the above-outlined type from which the earlier-described disadvantages are eliminated, which is structurally particularly simple and which makes possible an improved measurement of the running sliver.

This object and others to become apparent as the specification progresses, are accomplished by the invention, according to which, briefly stated, the apparatus for advancing a sliver and sensing thickness variations thereof in a fiber processing machine includes a tongue-and-groove roll pair composed of a tongue roll and a groove roll. The groove roll is radially fixedly supported and has a circumferentially extending groove including a groove bottom. The tongue roll projects into the groove and defines, with the groove roll, a nip through which the sliver passes for being compressed and advanced by the tongue-and-groove roll pair. The apparatus further has a sensing device including a biased, movably supported sensor element projecting into the groove of the groove roll and cooperating with the groove bottom upstream of the nip as viewed in a direction of sliver advance for pressing the sliver against the groove bottom and for undergoing excursions in response to thickness variations of the sliver passing between the sensor element and the groove bottom.

According to the invention, for the measuring process the groove bottom of the groove roll is used as a counter supporting element which cooperates with the sensor element. The apparatus according to the invention ensures that the slivers are densified and scanned by the sensor element upstream of the nip defined by the tongue-and-groove roll pair (pull-off rolls), so that the latter merely needs to pull through the earlier-sensed running sliver. These measures permit a separation of function by providing that the sensor element arranged upstream of the pull-off rolls simultaneously densifies and scans the running sliver in a simple manner. The after-connected pull-off rolls may be of simplified structure and, as far as their installation is concerned, may be significantly simpler since they function exclusively as a pulling mechanism. Particularly by eliminating the measuring function of the pull-off roll pair, the significant difficulties and complexities experienced in the measuring process performed by the conventional apparatus are avoided. Thus, the slivers are submitted to a separate handling as concerns a densification which is required for the mechanical scanning step and a densification required for the sliver-advancing (sliver-pulling) step. Accordingly, the apparatus according to the invention provides an improved measuring of the sliver bundle at the inlet of the drawing unit and further, the side walls of the groove roller ensure that the lateral guidance and support of the slivers is preserved.

BRIEF DESCRIPTION OF THE DRAWINGS

FIG. 3*b* is a schematic front elevational view of a ganged construction, composed of units illustrated in FIGS. 2 and 3*a*, for sensing and advancing individual slivers.

FIG. 4*a* is a schematic top plan view of a further preferred embodiment including a tongue-and-groove roll pair for sensing and advancing a sliver bundle formed of a plurality of slivers.

FIG. 4*d* is a sectional view taken along line IVd—IVd of FIG. 4*c*.

FIG. 4*e* is a sectional view taken along line IVe—IVe of FIG. 4*c*.

FIG. 5 is a schematic side elevational view illustrating a variant of the structure shown in FIG. 2.

FIG. 6 is a schematic side elevational view illustrating yet another variant of the structure shown in FIG. 2.

FIG. 7 is a schematic perspective view of a guide trough assembly for the slivers, adapted to be arranged upstream of the apparatus shown in FIG. 3*b* as viewed in the direction of sliver run.

DESCRIPTION OF THE PREFERRED EMBODIMENTS

Figure 1:
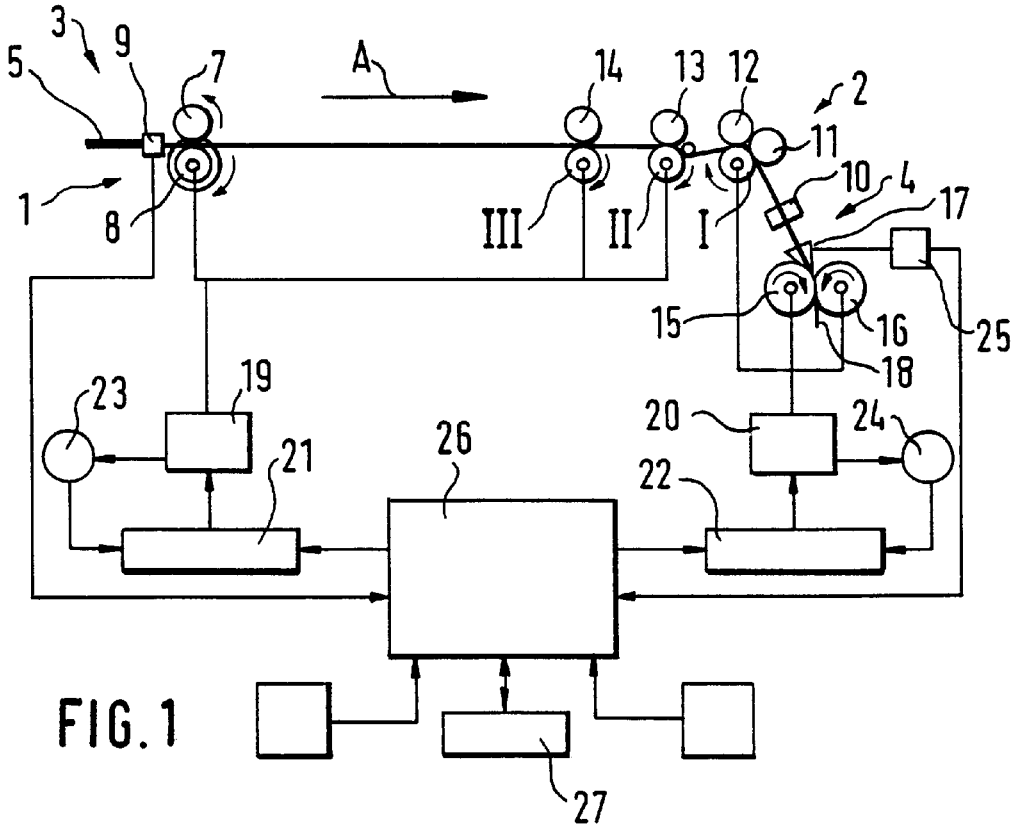
FIG. 1 is a schematic side elevational view of a regulated draw frame incorporating the apparatus according to the invention.

FIG. 1 shows a draw frame generally designated at 1 which may be an HSR model manufactured by Trützschler GmbH & Co. KG, Monchengladbach, Germany. The draw frame 1 includes a drawing unit 2, a drawing unit inlet 3 and a drawing unit outlet 4. Slivers 5 simultaneously treated by the draw frame are pulled through a measuring device 9 by cooperating pull-off rolls 7 and 8. The drawing unit is a 4-over-3 structure, that is, it is composed of three lower rolls I, II and III (that is, a lower output roll I, a lower mid roll II and a lower input roll III) and four upper rolls 11, 12, 13 and 14. The drawing unit 2 draws the sliver bundle 5 composed of a plurality of slivers. The drawing operation is composed of a preliminary and a principal drawing operation. The roll pairs 14,III and 13,II constitute the preliminary drawing field whereas the roll pairs 13,II and the three rolls 11, 12 and I constitute the principal drawing field. The drawn slivers are admitted at the drawing unit outlet 4 to a sliver guide 10 and are, by means of pull-off rolls 15 and 16, pulled through a sliver trumpet 17 in which the slivers are gathered to form a single sliver bundle 18 which is subsequently deposited in coiler cans.

The pull-off rolls 7, 8, the lower input roll III and the lower mid roll II which are mechanically coupled to one another, for example, by drive belts, are driven by a regulating motor 19 as a function of an inputted desired rpm. The associated upper rolls 14 and 13 are driven by friction. The lower output roll I and the pull-off rolls 15 and 16 are driven by a main motor 20. The regulating motor 19 and the main motor 20 each have a respective regulator 21 and 22. The rpm regulation is effected via a closed regulating circuit in which a tachogenerator 23 is associated with the regulating motor 19 and a tachogenerator 24 is associated with the main motor 20. At the drawing unit inlet 3 a dimension of the slivers that is proportionate to the fiber mass, such as the sliver cross section is measured by the intake measuring device 9. At the drawing unit outlet 4 the cross section of the exiting sliver bundle 18 is determined by an outlet measuring device 25 associated with the sliver trumpet 17.

A central computer unit 26 (control and regulating device), for example, a microcomputer with microprocessor, applies, to the regulator 21, a setting signal representing a desired magnitude for the regulating motor 19. The measuring magnitudes of the measuring device 9 are applied to the central computer unit 26 during the drawing process. The setting value for the regulating motor 19 is determined in the central computer unit 26 from the measuring magnitudes of the measuring device 9 and from the desired value for the cross section of the exiting sliver bundle 18. The measuring magnitudes of the outlet measuring device 25 serve for monitoring the exiting sliver bundle 18. With the aid of the regulating system, fluctuations in the cross section of the inputted slivers may be compensated for by corresponding regulations in the preliminary drawing process to thus achieve an evening of the outputted, drawn sliver bundle 18.

Figure 2:
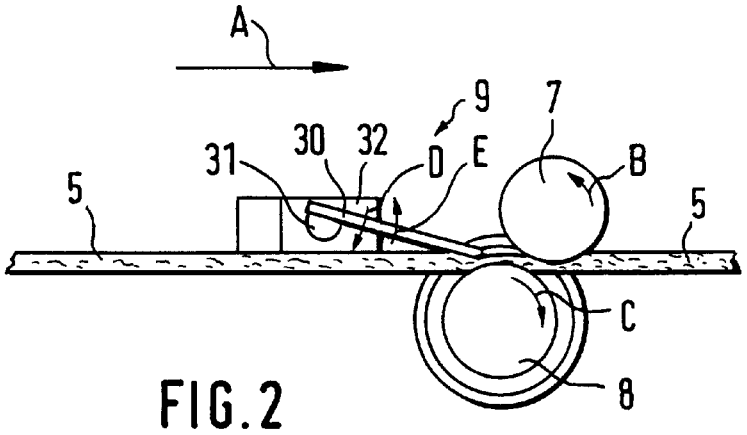
FIG. 2 is a schematic side elevational view of a preferred embodiment of the invention.

FIG. 2 illustrates a driven tongue-and-groove roll pair composed of a groove roll 8 and a tongue roll 7. The rolls 7 and 8 rotate in the direction of the arrows B and C, respectively. The groove of the groove roll 8 and the tongue of the tongue roll 7 together define a gap (nip) through which the sliver may pass. While the rolls 7, 8 are both radially stationarily supported during operation, the distance between their respective rotary axes may be adjusted.

A measuring device 9, arranged upstream of the roll clearance formed by the rolls 7 and 8, as viewed in the sliver advancing direction A, has a longitudinal, biasable sensor element 30, such as a pivotal sensor lever, which is movable in the direction of the arrows D and E. The sensor element 30 has, at one end, a holding member, such as a support shaft 31 which is supported in a bearing 32. The other end of the sensor element 30 which projects into the groove of the roll 8 is arranged immediately upstream of the roll clearance (nip) which is formed by the rolls 7, 8 and through which the sliver 5 passes.

Figure 2A:
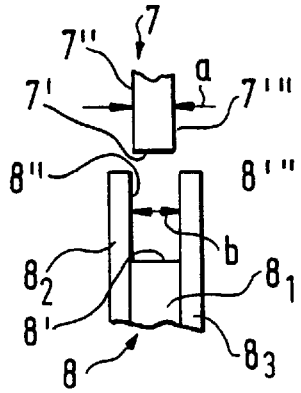
FIG. 2*a* is an exploded fragmentary front elevational view of two components of the structure shown in FIG. 2.

Also referring to FIG. 2*a*, the tongue of the roll 7 has a cylindrical peripheral edge face 7' and two opposite radial lateral faces 7" and 7'". The tongue roll 7 has an axially measured thickness a. The groove of the roll 8 is composed of a center disk $\mathbf{8}_1$ and two flanking disks $\mathbf{8}_2$ and $\mathbf{8}_3$. The peripheral surface of the center disk $\mathbf{8}_1$ forms a cylindrical groove bottom 8' of the groove roll 8, whereas the inner radial faces of the flanking disks $\mathbf{8}_2$ and $\mathbf{8}_3$ form two opposite radial lateral groove wall faces 8", 8'" spaced at a distance b from one another. The distance b is so dimensioned relative to the distance a that the tongue roll 7 may penetrate with a minimum clearance into the space defined between the groove wall faces 8' and 8'".

In operation, the outer free end of the sensor element 30 presses the sliver 5 against the groove bottom 8' moving in the direction C. Thus, the groove bottom 8' forms a supporting counter face cooperating with the sensor element 30. The sliver 5 glides under the sensor element 30 while it is being scanned and densified. The lateral groove walls 8", 8'" form a lateral support and guide for the sliver 5 and thus prevent it from spreading towards either lateral side.

Figure 3A:
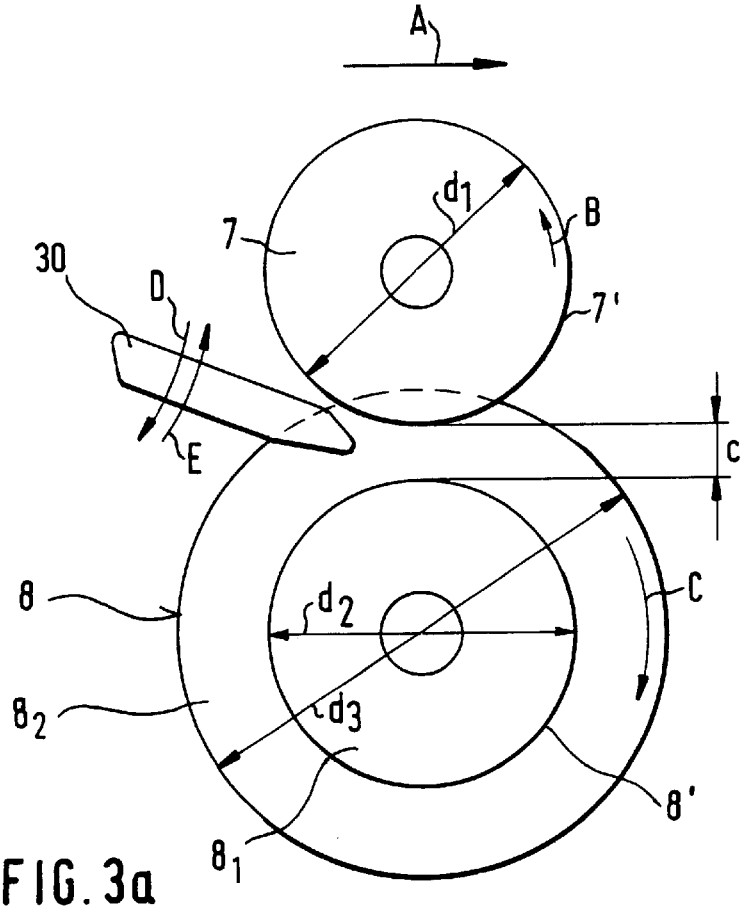
FIG. 3*a* is an enlarged side elevational view of a detail of the construction shown in FIG. 2.

As illustrated in FIG. 3*a*, the peripheral surface 7' of the tongue roll 7 and the groove bottom surface 8' of the groove roll 8 have a distance c from one another. The diameter $d_1$ of the tongue roll 7 and the diameter $d_2$ of the middle disk $\mathbf{8}_1$ of the groove roll 8 are identical to one another, while the diameter $d_3$ of the outer (flanking) disks $\mathbf{8}_2$ and $\mathbf{8}_3$ is greater than the diameter $d_2$. The width (thickness) of the sensor element 30 measured parallel to the rotary axes of rolls 7, 8 essentially corresponds to the dimension a to ensure that it fits between the two flanking disks $\mathbf{8}_2$ and $\mathbf{8}_3$ of the groove roll 8.

In operation, the running sliver is densified between the sensor element 30 and the groove bottom 8' of the groove roller 8 only to such an extent as necessary for the sensing of the thickness and/or irregularities (thickness variations) without adversely affecting the advancing of the sliver in the direction A. In the nip between the tongue roll 7 and the groove roll 8 the fiber material is densified only to an extent as necessary for its conveyance by the roll pair 7, 8. Thus, the fiber material need not be densified to such an extent that a solid cross section is obtained.

The embodiment illustrated in FIG. 3*b* is composed of a plurality of tongue-and-groove roll pairs 7, 8, wherein the tongue rolls 7 are mounted on a joint shaft 32 and the groove rolls 8 are mounted on a joint shaft 33, spaced from and parallel to the shaft 32. The sensing device 9 is provided with a plurality of sensor elements 30, so that with each tongue-and-groove roll pair 7, 8 a respective sensor element 30 is associated, as described in connection with FIGS. 2 and 3*a*. The FIG. 3*b* embodiment is designed for treating (densifying, measuring and advancing) individual running slivers 5*a*–5*f*. Accordingly, in the ganged roll structure of FIG. 3*b*, the signals derived from the excursions of the individual sensor elements 30 are added. The embodiment shown in FIG. 3*b* makes possible a substantially parallel, spaced guidance of the individual slivers 5*a*–5*f* from the drawing unit inlet 3 through the drawing unit 2 up to the sliver guide 10 of the drawing unit outlet 10. This structure thus prevents the slivers 5*a*–5*f* from converging, diverging or from being exposed to any irregular guidance.

Figure 4B:
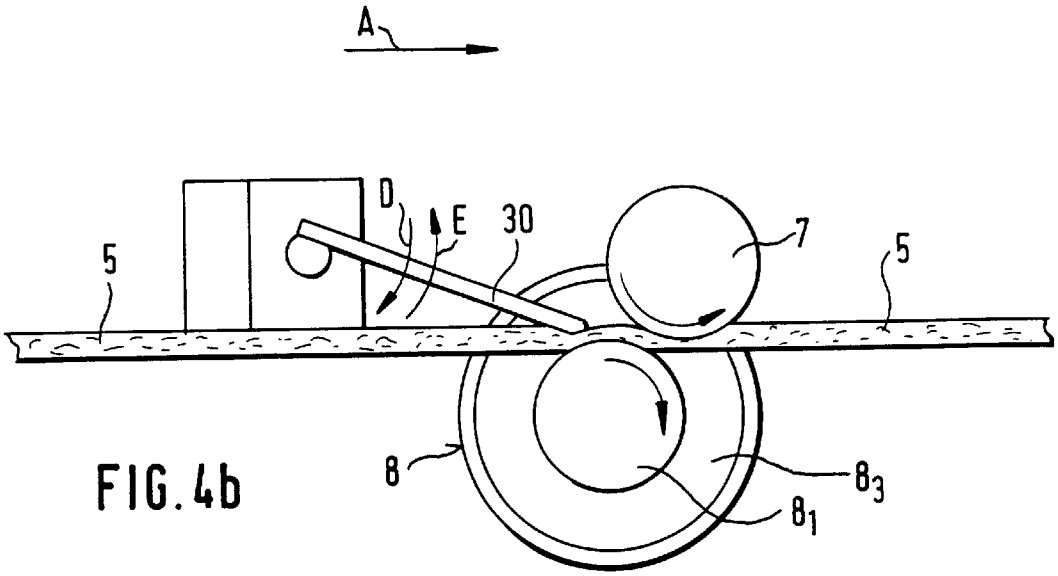
FIG. 4*b* is a side elevational view of the construction shown in FIG. 4*a*.

FIGS. 4*a*–4*e* show a further embodiment in which, as shown in FIG. 4*a*, a sliver bundle 5 formed, for example, of six individual slivers 5*a*–5*f* is jointly scanned and jointly pulled through the tongue-and-groove roll pair 7, 8 which may be essentially of a construction described in conjunction with FIGS. 2, 2*a* and 3*a*. The sliver bundle 5 is, in a known manner, caused to laterally converge in the advancing direction A and is thereafter scanned by the sensor element 30. Thereafter, the sliver bundle 5 passes through the clearance (nip) formed between the rolls 7 and 8 and is then caused to diverge. In this structure, a single tongue-and-groove roll pair 7, 8 and a single sensor element 30 are provided. As also shown in FIG. 4*a*, the flanking disks $\mathbf{8}_2$ and $\mathbf{8}_3$ of the groove roll 8 have at the radially outer end of the respective groove side walls 8", 8'" a circumferential chamfered region $\mathbf{8}^{IV}$ and $\mathbf{8}^{V}$, so that the groove side walls 8", 8'", as viewed radially outwardly, continue as a widening surface which facilitates a satisfactory introduction of the sliver bundle 5 into the groove-and-roll pair 7, 8.

Figure 4C:
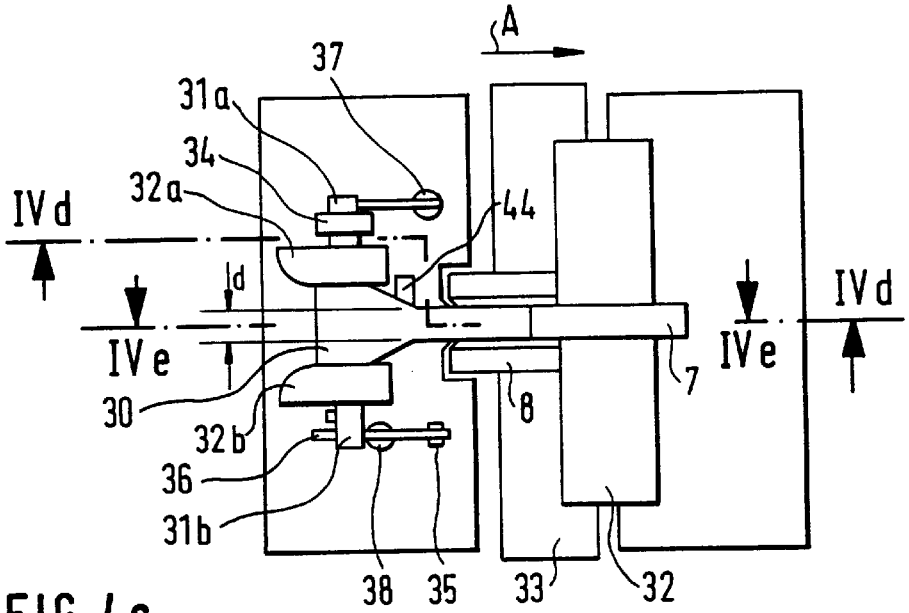
FIG. 4*c* is a view similar to FIG. 4*a* shown without the presence of fiber material.

As shown in FIG. 4*c*, the tongue roll 7 extends into the groove roll 8. The sensor element 30 which extends with its free end into the groove of the groove roll 8 is supported at its other end by a support shaft 31 which is rotatably held in bearing elements 32*a*, 32*b*. As shown in FIG. 4*d*, at one end 31*a* of the pivot shaft 31 an end of a biasing lever 34 is secured which, with its other end, is charged by a spring 37 supported on the machine frame. At the other end 31*b* of the shaft 31, as shown in FIG. 4*e*, an end of a biasing lever 34 is attached which, in turn, is charged at its other end by a spring 37 also supported in the machine frame. At the other end 31*b* a lever 36 is secured which cooperates with a lever arm 39*a* of a rotatably supported dual lever 39 whose other lever arm 39*b* is exposed to the force of a tension spring 38 which is countersupported on the machine frame. A transducer 35, such as an inductive path sensor, is connected with the other end of the lever arm 39*b* for converting excursions into electric pulses. The machine frame components are designated at 40 and 41.

Turning to FIG. 5, between the outer, free end of the sensor element 30 and the groove bottom 8' the end of a stationarily held counter support element 42, such as a plate or the like is provided which also projects into the groove of the roll 8. The fiber material 5 is pulled through between the two adjacent ends of the counterelement 42 and the sensor element 30 by the roll pair 7, 8.

According to FIG. 6, the outer end of the sensor element 30 carries a rotatable roller 43 and the fiber material 5 is pulled by the roll pair 7, 8 between the peripheral surface of the roller 43 and the groove bottom 8'. In such a construction the fiber material is surrounded during sensing by four movable surfaces, that is, the peripheral surface of the roller 43, the groove bottom 8' and the lateral groove faces 8", 8'"

FIG. 7 shows a guide trough 45 which is provided with a plurality of longitudinally extending parallel grooves (troughs) each accommodating a separate sliver 5*a*–5*f*. The trough 45 is arranged upstream of the construction illustrated in FIG. 3*b*. By the motion of the slivers 5*a*–5*f* the longitudinal grooves are self cleaned and thus dust and fiber fly and the like are removed. By means of the guidance within the guide grooves a fluttering, sagging or lateral excursion of the slivers 5*a*–5*f* is prevented.

It will be understood that the above description of the present invention is susceptible to various modifications, changes and adaptations, and the same are intended to be comprehended within the meaning and range of equivalents of the appended claims.

What is claimed is:

1. An apparatus for advancing a sliver and sensing thickness variations thereof in a fiber processing machine, comprising (a) a tongue-and-groove roll pair composed of a tongue roll and a groove roll; said groove roll being radially fixedly supported and having a circumferentially extending groove including a groove bottom; said tongue roll projecting into said groove and defining, with said groove roll, a nip through which said sliver passes for being compressed and advanced by said tongue-and-groove roll pair; and (b) a sensing device including a biased, movably supported sensor element projecting into said groove and cooperating with said groove bottom upstream of said nip as viewed in a direction of sliver advance for pressing the sliver against said groove bottom and for undergoing excursions in response to thickness variations of the sliver passing between said sensor element and said groove bottom.

2. The apparatus as defined in claim 1, wherein said tongue roll is radially stationarily supported.

3. The apparatus as defined in claim 1, further comprising a transducer connected to said sensor element for converting excursions thereof into electric control signals.

4. The apparatus as defined in claim 3, wherein said sensing device comprises a spring urging said sensor element toward said groove bottom.

5. The apparatus as defined in claim 1, further comprising a support shaft; said sensor element being secured to said support shaft for transmitting from said sensor element a torque to said support shaft upon excursions of said sensor element in response to thickness variations of the sliver.

6. The apparatus as defined in claim 5, wherein said support shaft is supported at an end thereof by means of a torsion bar.

7. The apparatus as defined in claim 5, wherein said support shaft is supported at an end thereof by means of a rotary bearing.

8. The apparatus as defined in claim 5, further comprising a transducer connected to said support shaft for converting said torque into electric control signals.

9. The apparatus as defined in claim 1, further comprising a bight defined together by a circumferential portion of said tongue roll and a circumferential portion of said groove roll; said bight including said nip; said sensor element extending into said bight.

10. The apparatus as defined in claim 1, wherein said fiber processing machine is a draw frame having a drawing unit provided with an inlet; said sensing device and said tongue-and-groove roll pair being arranged at said inlet.

11. The apparatus as defined in claim 1, wherein said groove has opposite side walls connected by said groove bottom; further wherein each said side wall has a chamfered radially outer portion, whereby said groove widens along a radially outer, open end thereof.

12. The apparatus as defined in claim 1, further comprising a fixed counter element extending into said groove; said sensor element pressing the sliver against said counter element and said groove bottom.

13. The apparatus as defined in claim 1, further comprising a roller forming part of said sensor element and constituting a sliver-contacting part thereof for pressing the sliver against said groove bottom.

14. An apparatus for simultaneously advancing a plurality of slivers and sensing thickness variations thereof in a fiber processing machine, comprising (a) a plurality of tongue-and-groove roll pairs each composed of a tongue roll and a groove roll; each said groove roll being radially fixedly supported and having a circumferentially extending groove including a groove bottom; each said tongue roll projecting into said groove of a respective said groove roll and defining, with said respective groove roll, a nip through which a respective single sliver passes for being compressed and advanced by said tongue-and-groove roll pair; and (b) a sensing device including a plurality of biased, movably supported sensor elements each projecting into a respective said groove and cooperating with said groove bottom of said respective groove upstream of said nip as viewed in a direction of sliver advance for pressing each sliver against a respective said groove bottom and for undergoing excursions in response to thickness variations of the sliver passing between said sensor element and said groove bottom.

15. The apparatus as defined in claim 14, wherein said sensing device comprises a holding member supporting said sensor elements; the excursions of each sensor element being transmitted to said holding member, whereby said holding member receives a sum of the excursions.

16. The apparatus as defined in claim 15, further comprising a support for rotatably supporting said holding member and a force-transmitting element biasing said holding member.

17. The apparatus as defined in claim 15, further comprising a transducer connected to said holding member for converting the excursions applied to said holding member into electric signals.

18. The apparatus as defined in claim 14, further comprising a sliver guiding member disposed upstream of said sensing device; said sliver guiding member having a plurality of side-by-side arranged troughs for guiding individual slivers to said plurality of tongue-and-groove roll pairs.

19. The apparatus as defined in claim 14, further comprising a first shaft supporting said tongue rolls and a second shaft spaced from and parallel to said first shaft; said second shaft supporting said groove rolls.

* * * * *